US006426047B1

(12) United States Patent
Hamel et al.

(10) Patent No.: US 6,426,047 B1
(45) Date of Patent: Jul. 30, 2002

(54) DISPOSABLE TIP MAGAZINE

(75) Inventors: Marc Hamel, Hudson; Daniel J. Seguin, Amherst, both of NH (US)

(73) Assignee: Matrix Technologies Corporations, Hudson, NH (US)

( * ) Notice: Subject to any disclaimer, the term of this patent is extended or adjusted under 35 U.S.C. 154(b) by 0 days.

(21) Appl. No.: 09/241,497

(22) Filed: Feb. 1, 1999

(51) Int. Cl.[7] ..... B01L 3/02

(52) U.S. Cl. ..... 422/100; 422/99; 422/104; 422/103

(58) Field of Search ..... 422/100, 103, 422/104, 99; 206/499, 486, 562, 503, 563

(56) References Cited

U.S. PATENT DOCUMENTS

| | | | | |
|---|---|---|---|---|
| 3,853,217 | A | * | 12/1974 | Scardato |
| 3,937,322 | A | * | 2/1976 | Cohen |
| 4,349,109 | A | | 9/1982 | Scordato et al. |
| 4,577,760 | A | * | 3/1986 | Rainin |
| 4,676,377 | A | * | 6/1987 | Rainin |
| 4,919,894 | A | * | 4/1990 | Daniel |
| 4,936,152 | A | * | 6/1990 | Aldred |
| D323,400 | S | * | 1/1992 | Frenkel |
| 5,200,151 | A | | 4/1993 | Long |
| 5,232,669 | A | | 8/1993 | Pardinas et al. |
| 5,306,510 | A | | 4/1994 | Meltzer |
| 5,324,482 | A | | 6/1994 | Scaramella et al. |
| 5,366,088 | A | | 11/1994 | Hill et al. |
| 5,392,914 | A | * | 2/1995 | Lemieux |
| 5,470,538 | A | * | 11/1995 | Lind |
| 5,487,997 | A | | 1/1996 | Stolp |
| 5,570,566 | A | | 11/1996 | Newcomb |
| 5,588,792 | A | | 12/1996 | Tiso |
| 5,622,676 | A | | 4/1997 | Lind |
| 5,630,988 | A | * | 5/1997 | Stolp |
| 5,642,816 | A | * | 7/1997 | Kelly |
| 5,770,860 | A | | 6/1998 | Franzen |
| 5,779,984 | A | * | 7/1998 | Kelly |
| 5,827,745 | A | | 10/1998 | Astle |
| 5,882,603 | A | * | 3/1999 | Taggart |
| 5,948,362 | A | * | 9/1999 | Steinbrenner |
| 6,019,225 | A | * | 2/2000 | Kalmakis |
| 6,087,433 | A | * | 7/2000 | Hanada |
| 6,087,435 | A | * | 7/2000 | Nakano |
| 6,087,467 | A | * | 7/2000 | Marrocco |

FOREIGN PATENT DOCUMENTS

EP 0703455 A1 3/1996

OTHER PUBLICATIONS

CRC Handbook of Chemistry and Physics. Robert C. Weast and Melvin J. Astle (Eds.) 63rd Edition (1984). pp. 780–782.* http://www.bio–world.com/catalog/102.html; dated Jan. 11, 1999; pp. 1–3.

* cited by examiner

*Primary Examiner*—Jill Warden
*Assistant Examiner*—Brian Sines
(74) *Attorney, Agent, or Firm*—Samuels, Gauthier & Stevens

(57) ABSTRACT

A pipette tip magazine used in an automated pipetting system which has a pipetting chamber with a generally U-shaped ledge. The pipette tip magazine is adapted for insertion into and removal from an operative position contained in the chamber and supported on the ledge. The magazine includes a generally rectangular plate having an undercut edge bordering an inner region. The edge is configured to be supported on the ledge, an the inner region has an array of through openings for vertically receiving and retaining pipette tips. The plate is molded from a polymeric resin reinforced with a fibrous material.

7 Claims, 3 Drawing Sheets

DISPOSABLE TIP MAGAZINE

BACKGROUND OF THE INVENTION

1. Field of the Invention

This invention relates to automated pipetting systems, and is concerned in particular with the provision of a low-cost disposable magazine for loading pipette tips into such systems.

2. Description of the Prior Art

This invention is especially adapted for, although not limited to, use with the PLATEMATE™ pipetting systems marketed by Matrix Technologies Corp. of Hudson, N.H., U.S.A. Such systems employ rigid metal magazines, for the pipette tips. The metal magazines are expensive components and are thus continually reused in successive pipetting cycles. Magazine reuse inevitably requires laboratory personnel to frequently empty and refill them with fresh pipettes. This has been found to be a time consuming, inefficient and cumbersome procedure, but one that was deemed necessary because of the belief that only steel magazines could provide the rigidity required to resist deflection during the pipetting process.

During the pipetting process, in order to ensure a uniform seal across all of the pipette tips in the magazine, substantial force must be exerted on the magazine. If the magazine is not rigid enough, there will be some deflection across the face of the magazine.

It is important that the magazine be as flat as possible. If there is too much deflection, all of the faces of the pipette tips will not adequately seal, causing an air leak and thus uneven pipetting. The automated pipettor may be used to dispense samples into 96, 384 or 1536 well plates. It is extremely important that the pipettes be perpendicular to the magazine. If there is too much deflection and the pipette tips are slightly angled, the sample will be pipetted into an incorrect well or on a wall causing cross contamination. Precision is especially required when using the 384 or the 1536 well plates.

The objective of the present invention is to provide an improved low-cost pipette magazine which may be discarded after a single use, thus accordingly, alleviating the drawbacks associated with the prior art reusable magazines.

SUMMARY OF THE INVENTION

The present invention stems from the discovery that a pipette magazine of adequate rigidity and stiffness can be molded from a polymeric material, with the attendant reduction in costs being such that the magazine can be economically discarded after a single use.

BRIEF DESCRIPTION OF THE DRAWINGS

Other objects, features and advantages of the present invention will become more apparent as the description proceeds with reference to the accompanying drawings, wherein.

DETAILED DESCRIPTION OF PREFERRED EMBODIMENT

Figure 1:
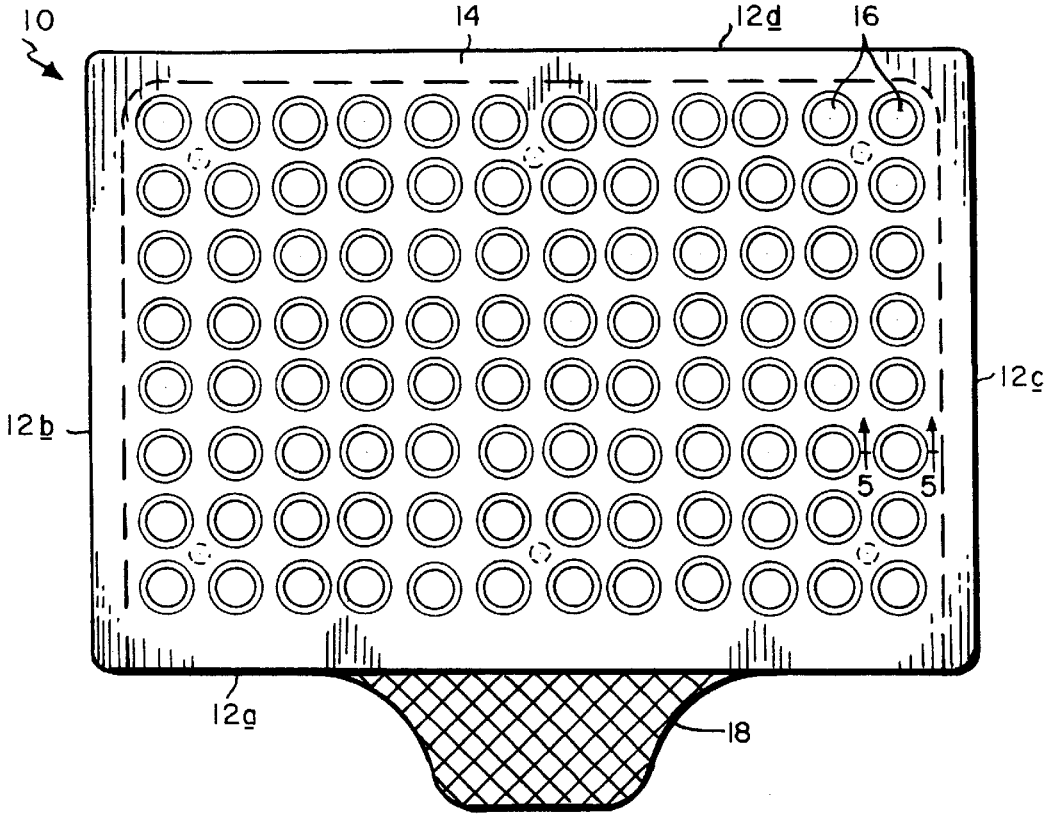
FIG. 1 is a top plan view of a pipette tip magazine in accordance with the present invention.
Figure 3:
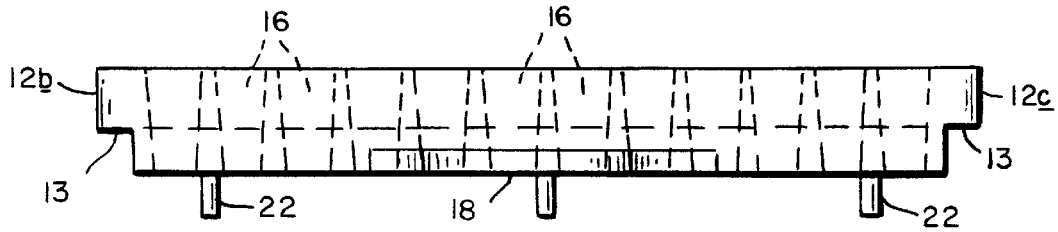
FIG. 3 is a front view of the pipette tip magazine.
Figure 5:
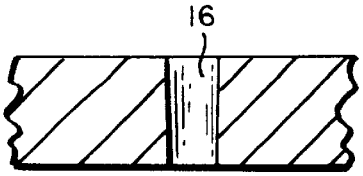
FIG. 5 is a sectional view taken along line 5—5 in FIG. 1.
Figure 2:
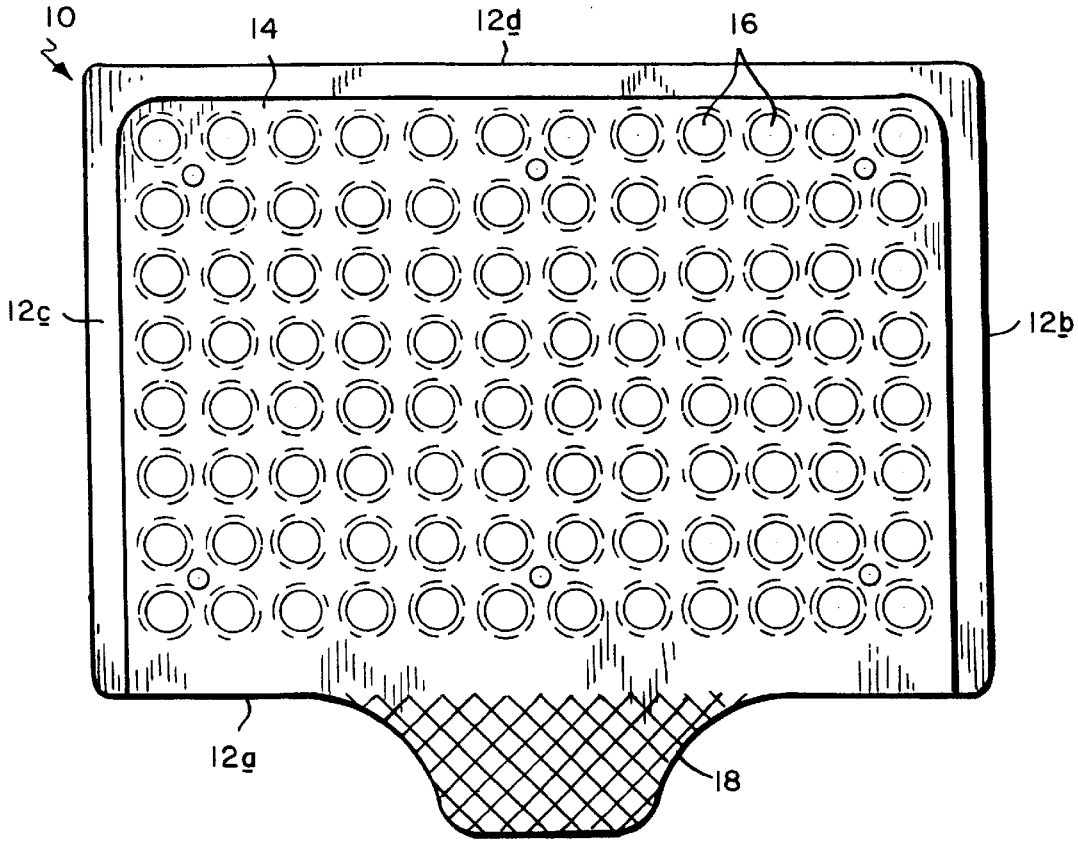
FIG. 2 is a bottom plan view of the pipette tip magazine.
Figure 4:
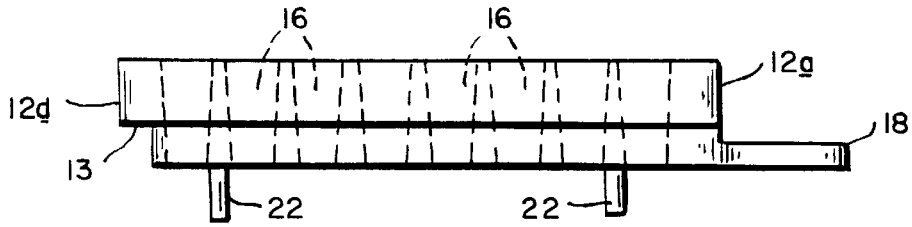
FIG. 4 is a left side view of the pipette magazine.
Figure 6:
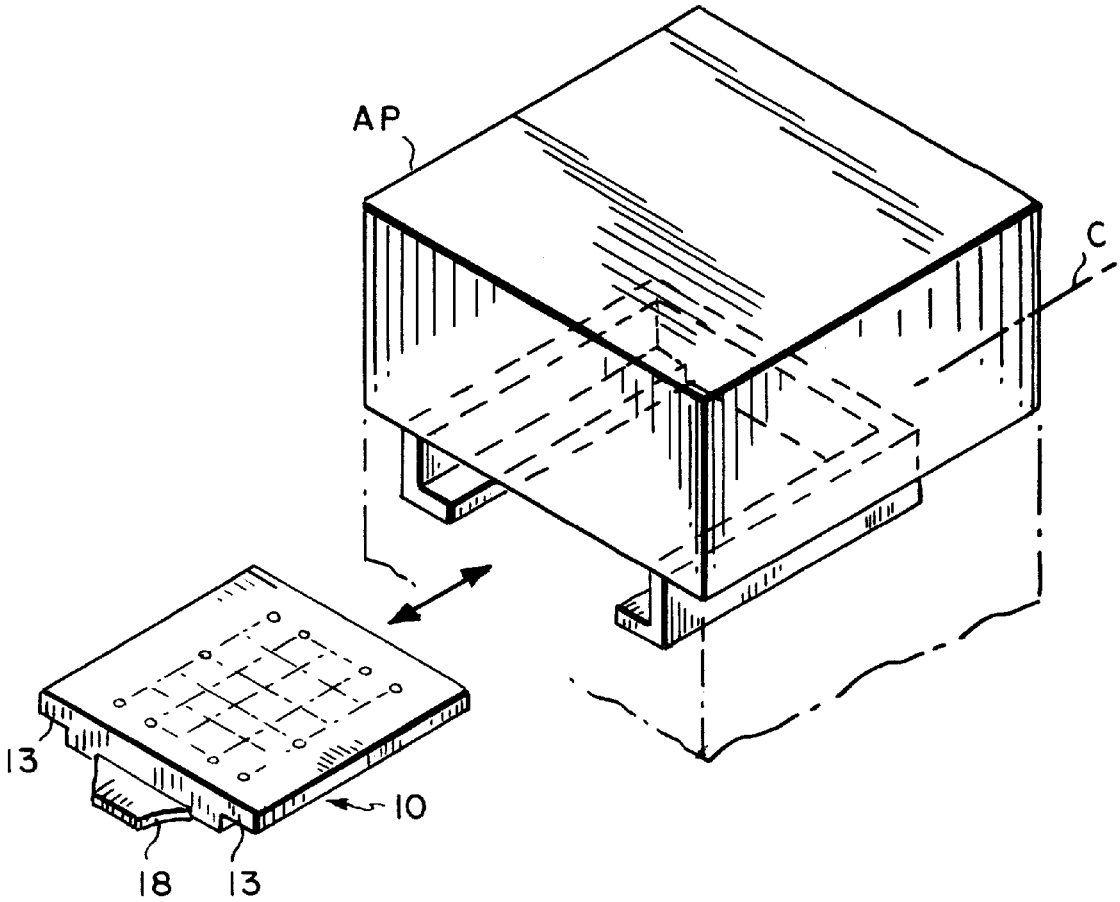
FIG. 6 is a schematic illustration of a pipetting system and its arronated pipette tip magazine.

A preferred embodiment of a pipette tip magazine in accordance with the present invention is generally depicted at 10 in the accompanying drawings. As shown somewhat schematically in FIG. 6, the magazine 10 is adapted for insertion into the pipetting chamber "C" of an automated pipettor. The chamber has a generally U-shaped ledge configured to support the magazine in an operative pipetting position, as well understood by those skilled in the art. The magazine 10 has a generally rectangular configuration having a front edge 12*a*, side edges 12*b*, 12*c* and a rear edge 12*d* surrounding an inner region 14. The edges 12*b*, 12*c* and 12*d* are undercut as at 13 to be supported on the ledge of the chamber. The inner region 14 has an array of through openings 16 for vertically receiving and retaining pipette tips. A handle 18 protrudes from the front edge 12*a* to facilitate manual placement and removal of the magazine in the pipetting chamber C.

It has been found that the magazine 10 can be molded from a polymeric resin with sufficient inherent stiffness such that when the magazine is supported in its operative position on ledge 11, a downward force of up to approximately 1000 Newtons exerted on the inner region 14 will cause less than 0.51 mm of deflection, but preferably less than 0.38 mm of deflection at the point of force application, assuming the magazine was substantially flat when molded. Preferably, the polymeric resin will comprise a polycarbonate, which may include a filler such as glass fiber. The percentage of glass fiber to the polymeric material is preferably in a range of approximately 20 to 40 weight percent. Because the magazine is molded from a filled polymeric resin, it is relatively inexpensive, and thus may be discarded after a single use. Thus, the magazine may be supplied already filled with pipette tips and disposed after usage, thus obviating any need to resort to cumbersome time consuming reloading.

Preferably, the inner region 14 of the magazine comprises approximately 85% of the total surface area, with the remaining 15% comprising the edge region overlying the undercut 13 adapted to be seated on the ledge 11.

Typical dimensions for a suitable magazine are:

Total surface area: 98.5 $cm^2$

Width of undercut 13: 0.51 cm

Area supported on ledge 11: 14.3 $cm^2$

Maximum thickness: 0.90 cm

Bosses 22 may be included on the underside of the magazine to assist in the stacking of loaded magazines for packaging, such that they are easily displaced one from the other.

The foregoing description has been limited to a specific embodiment of the invention. It will be apparent, however, that variations and modifications can be made to the invention, with the attainment of some or all of the advantages. Therefore, it is the object of the claims to cover all such variations and modifications as come within the true spirit and scope of the invention.

What is now claimed is:

1. For use in an automated pipetting system having a pipetting chamber with a generally U-shaped ledge, a pipette tip magazine adapted for insertion into and removal from an operative position in said chamber supported on said ledge, said magazine comprising a generally rectangular plate having an undercut edge bordering an inner region, said edge being configured to be supported on said ledge, and said inner region having an array of through openings for vertically receiving and retaining pipette tips, said plate being molded from a polycarbonate resin filled with glass fiber and having an inherent stiffness such that when supported on said ledge, a downward force of up to about 1000 Newtons applied to the inner region will produce a downward deflection of said plate at the point of force application of not more than 0.51 mm.

2. The pipette tip magazine of claim 1, wherein the amount of said glass fiber is approximately 20 to 40% by weight of said polycarbonate resin.

3. The pipette tip magazine of claim 1, wherein the area of said undercut edge is between 10 to 15% of the total area of said plate.

4. The pipette tip magazine of claim 1 further comprising downwardly protruding bosses on the underside thereof, said bosses being configured and dimensioned to accommodate stacking of said magazines when filled with pipette tips.

5. The pipette tip magazine of claim 1, wherein said magazine has a flat upper surface.

6. For use in an automated pipetting system having a pipetting chamber with a generally U-shaped ledge, a pipette tip magazine adapted for insertion into and removal from an operative position contained in said chamber and supported on said ledge, said magazine comprising a generally rectangular plate having an undercut edge bordering an inner region, said edge being configured to be supported on said ledge, and said inner region having an array of through openings for vertically receiving and retaining pipette tips, said plate being molded from a polymeric resin reinforced with a fibrous material.

7. The pipette tip magazine of claim 6 wherein the amount of said fibrous material is approximately 20 to 40% by weight of said polymeric resin.

* * * * *

US006426047C1

(12) EX PARTE REEXAMINATION CERTIFICATE (5204th)

United States Patent
Hamel et al.

(10) Number: US 6,426,047 C1
(45) Certificate Issued: Sep. 20, 2005

(54) DISPOSABLE TIP MAGAZINE

(75) Inventors: Marc Hamel, Hudson, NH (US); Daniel J. Seguin, Amherst, NH (US)

(73) Assignee: Matrix Technologies Corporation, Hudson, NH (US)

Reexamination Request:
No. 90/006,525, Jan. 23, 2003

Reexamination Certificate for:

| | |
|---|---|
| Patent No.: | **6,426,047** |
| Issued: | **Jul. 30, 2002** |
| Appl. No.: | **09/241,497** |
| Filed: | **Feb. 1, 1999** |

(51) Int. Cl.[7] ..... B01L 3/02
(52) U.S. Cl. ..... 422/100; 422/99; 422/103; 422/104
(58) Field of Search ..... 422/99, 100, 103, 422/104; 206/499, 486, 562, 503, 563

(56) References Cited

U.S. PATENT DOCUMENTS

| | | | | |
|---|---|---|---|---|
| 4,577,760 A | | 3/1986 | Rainin et al. | 206/508 |
| 5,338,358 A | * | 8/1994 | Mizusawa et al. | 422/99 |
| 5,520,995 A | * | 5/1996 | Fukushima et al. | 428/216 |
| 5,630,988 A | | 5/1997 | Stolp | 422/100 |
| 5,882,603 A | | 3/1999 | Taggart | 422/104 |

OTHER PUBLICATIONS

Weast, Ph.D. et al., "CRC Handbook of Chemistry and Physics", CRC Press, Inc., 1982–1983.

* cited by examiner

*Primary Examiner*—Lyle A. Alexander

(57) ABSTRACT

A pipette tip magazine in an automated pipetting system which has a pipetting chamber with a generally U-shaped ledge. The pipette tip magazine is adapted for insertion into and removal from an operative position contained in the chamber and supported on the ledge. The magazine includes a generally rectangular plate having an undercut edge bordering an inner region. The edge is configured to be supported on the ledge, an the inner region has an array of through openings for vertically receiving and retaining pipette tips. The plate is molded from a polymeric resin reinforced with a fibrous material.

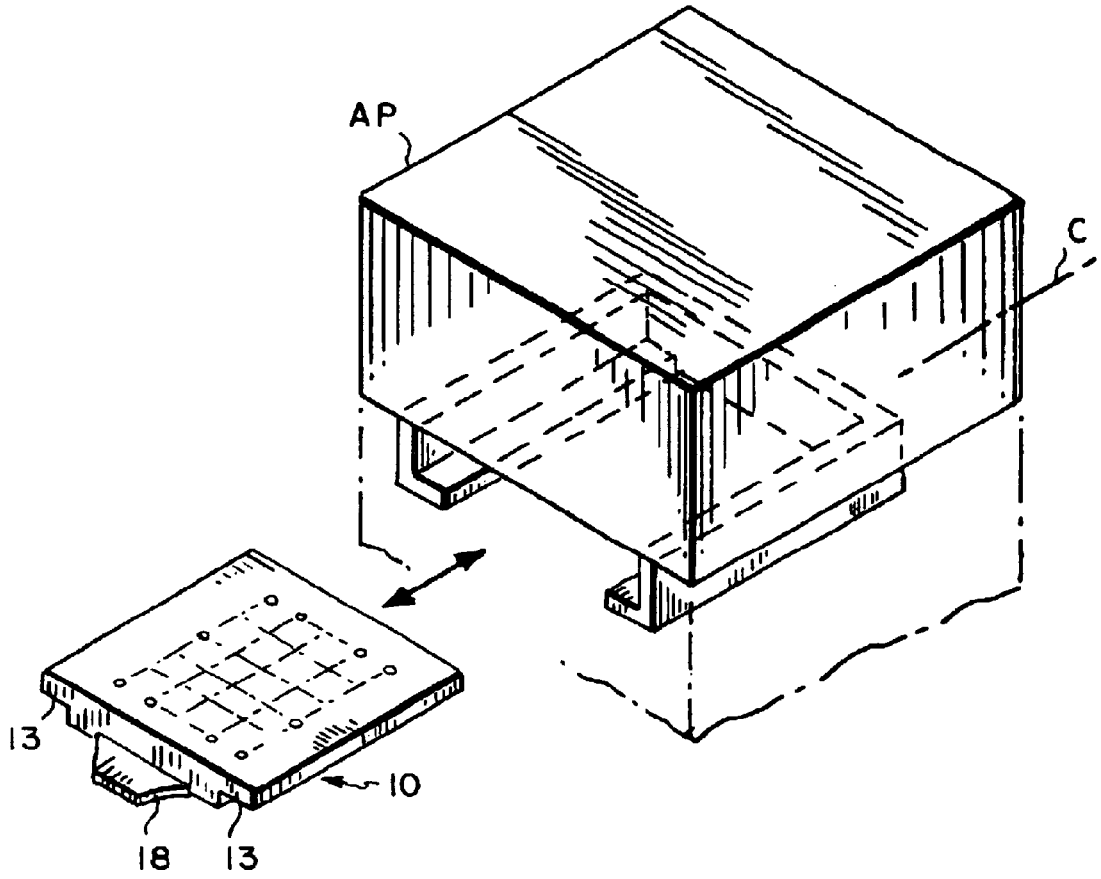

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *